United States Patent [19]

Fiegener et al.

[11] Patent Number: 4,604,178

[45] Date of Patent: Aug. 5, 1986

[54] ANODE

[75] Inventors: Dale R. Fiegener; Felix J. Broussard, both of Lake Jackson, Tex.

[73] Assignee: The Dow Chemical Company, Midland, Mich.

[21] Appl. No.: 707,312

[22] Filed: Mar. 1, 1985

[51] Int. Cl.[4] ..... C25C 7/02; C25B 11/12

[52] U.S. Cl. ..... 204/286; 204/294

[58] Field of Search ..... 204/70, 243 R, 286–289, 204/225, 245, 294, 279

[56] References Cited

U.S. PATENT DOCUMENTS

| | | | |
|---|---|---|---|
| 1,785,587 | 12/1930 | Kuhlmann | 204/294 X |
| 1,850,515 | 3/1932 | Peltz | 204/286 X |
| 2,458,272 | 1/1949 | Jones | 204/286 X |
| 2,845,293 | 7/1958 | Peckham, Jr. | 403/393 |
| 3,016,343 | 1/1962 | Krenzke | 204/286 X |
| 3,178,984 | 4/1965 | Barothy | 403/296 X |
| 3,359,449 | 12/1967 | Trask | 204/280 X |
| 3,536,460 | 10/1970 | Voelker | 204/286 X |
| 4,462,888 | 7/1984 | Koziol et al. | 204/286 |

*Primary Examiner*—Donald R. Valentine

*Attorney, Agent, or Firm*—Walter J. Lee

[57] ABSTRACT

For use in assembly of elongate sacrificial anodes consumed in process containers, apparatus for aligning and connecting anode sections to form a single segmented anode is disclosed wherein the aligning and connecting apparatus is composed of the same or similar sacrificial material. In the preferred and illustrated embodiment, a graphite collar member cooperative with a graphite threaded pin is set forth. The two are used in conjunction with a drilled and tapped bottom socket formed in a rectangular graphite mode block; preferably, duplicate systems are used on symmetrical sides to string several graphite anode blocks together in conjunction with a tapered counterbore at the end of a drill passage through the graphite block.

19 Claims, 7 Drawing Figures

FIG. 1
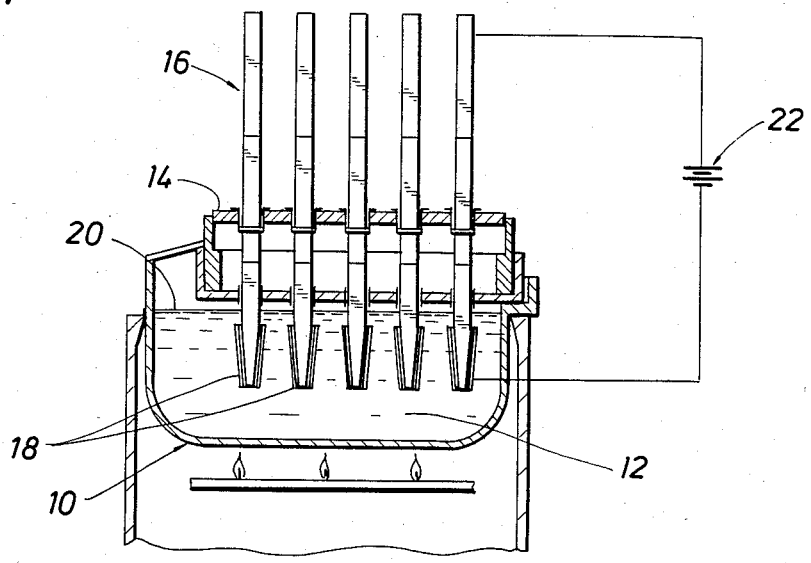
FIG. 2
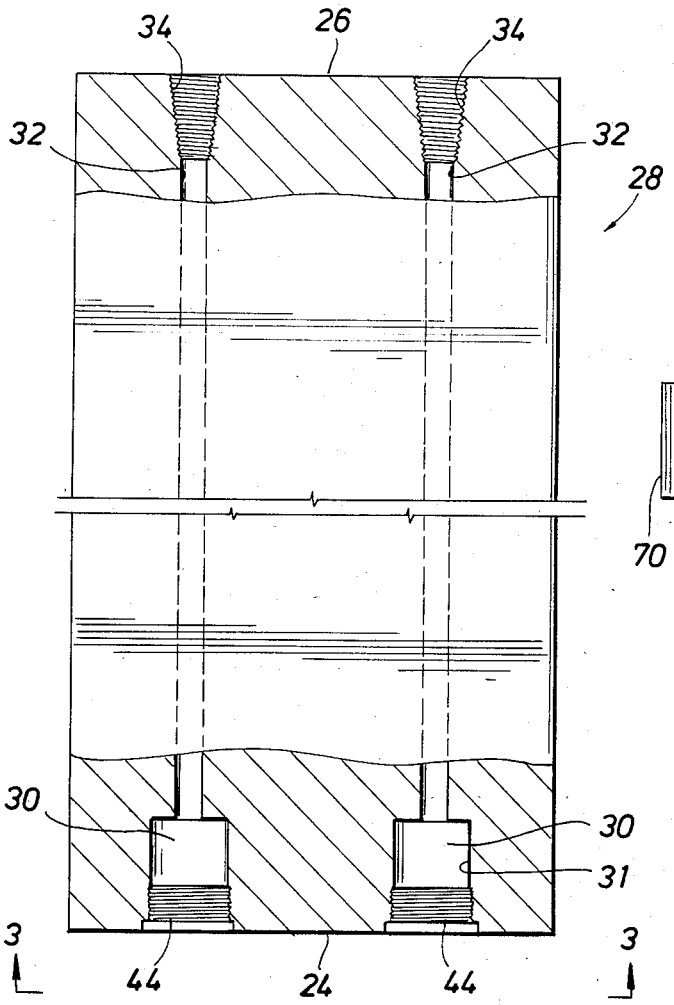
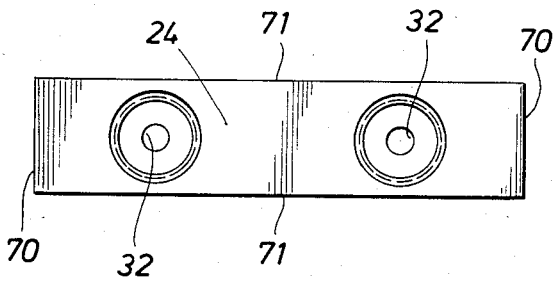
FIG. 3

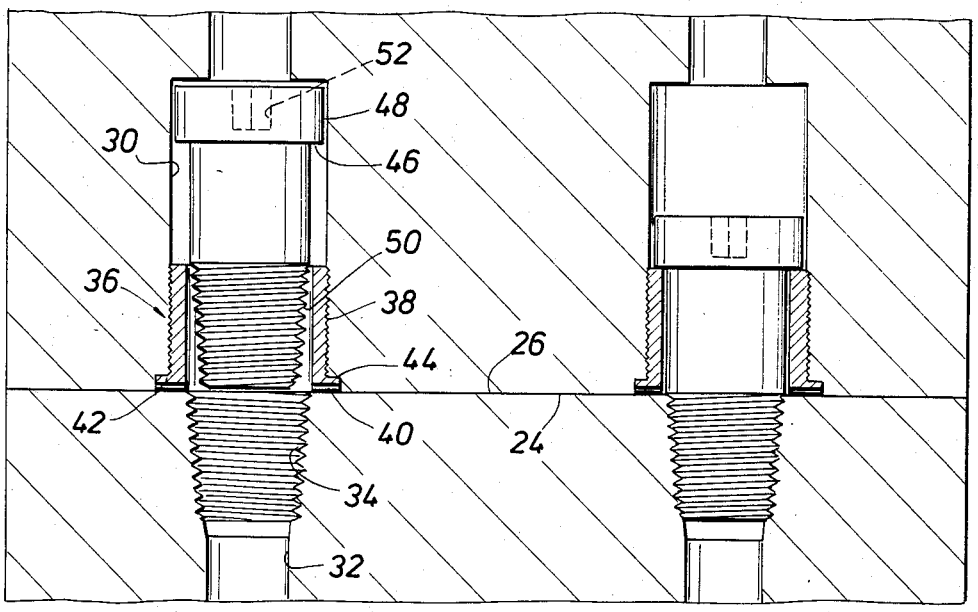
FIG. 4
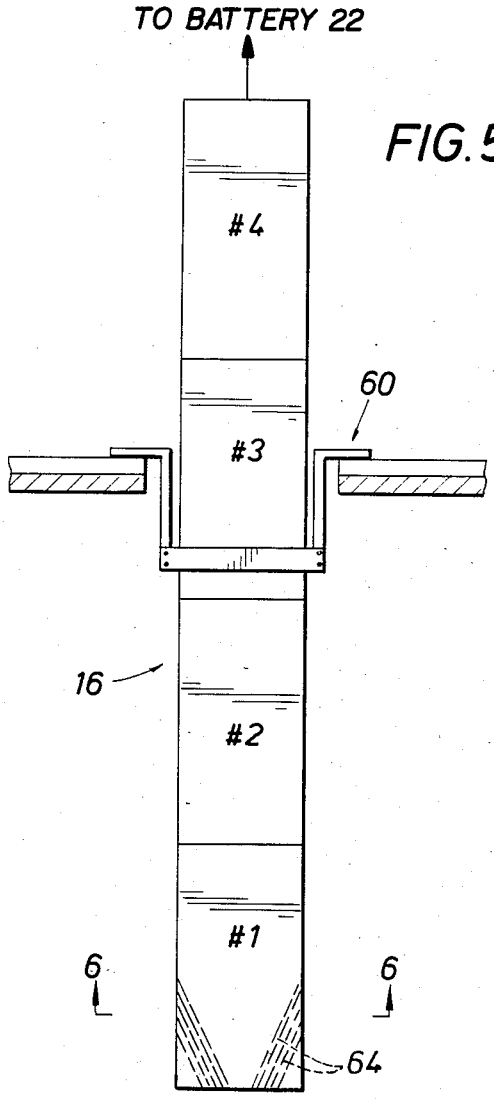
FIG. 5
FIG. 6
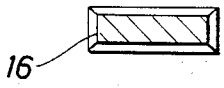
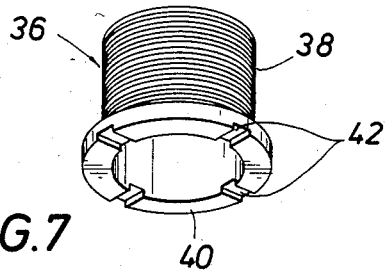
FIG. 7

ANODE

BACKGROUND OF THE DISCLOSURE

A sacrificial anode system is typically used in chemical conversion techniques for manufacture of pure magnesium, or other materials. In a typical process, some type of electrode system is suspended in a container. The reactants in the container are electrochemically converted to form pure materials. They are poured off from the container in some fashion. In large industrial applications, the container is quite large and hence, a substantial current flow is required. The current flow typically measures several hundred amperes or more. Such a current flow is applied through a sacrificial anode. The anode is typically consumed by the process. Even if three or four parallel anodes are used with a single container, when it is time to replace one of the anodes, the process is interrupted. The anodes can be quite large, perhaps about one foot or mode in diameter and many feet in length. They are supplied to the container continuously while the sacrificial anode is ultimately consumed. That is, it is converted by the process and the anode must therefore be continuously fed into the process. This requires a shut down to replace the anode. Regarding anodes which are substantial length, handling is more difficult with their size.

The present apparatus is directed to a system for making relatively short anode sections which are serially added to an assembled anode. If the anode sections are relatively short in length, several such sections can be joined together serially. In the ordinary circumstance, the bottom most anode portion is partially consumed in the process and should not be handled. Moreover, additional anode sections should be added at the top so that the anode can be fed continuously into a process. The present apparatus is a structure enabling continuous use of an anode while additional sections are added to the top to thereby extend the anode. Each anode section is affixed in a manner avoiding interference with the lower anode sections. This accesses personnel to anode sections at the top end of the anode. This is the portion well above the process container, and is particularly able to "elongate" the anode even during current flow through the anode because the point of connection is substantially above the portion of the anode undergoing current flow.

This apparatus is particularly advantageous over the devices known in the art. As an example, one such device is shown in U.S. Pat. No. 1,850,515 which has a set of particularly shaped metal nipples embedded in the structure. Moreover, it would appear that this reference requires a connecting rod in tension, the rod being positioned in a hole and extending from top to bottom of the anode. Another reference to interest is U.S. Pat. No. 3,016,343. This reference discloses a threaded plug which is somewhat difficult to thread into the lower anode portion and which is particularly difficult to thread up because the top and lower sections thereof have threads of a common hand. Moreover, as will be described, the two references do not set forth the type of structure which is shown and claimed hereinafter.

In general terms, the apparatus of the present disclosure is therefore described as an improved connector structure for use with segmented anode portions. Several anode sections serially are joined together to enable the assembled anode to be continuously lowered into a process container where the anode is consumed at the lower end and is lengthened at the upper end as needed. A clamp or collar is suitably positioned about the anode to hold it in place and to provide electrical connection. Moreover, the anode structure includes by suitable lengthwise passages terminating at a tapered countersunk opening at the upper end and a counterbored opening at the lower end to receive the pin and collar described hereinafter. The improved connector structure is further capable of ensuring positive, accurate alignment and positive abutment of the anode sections.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows a process container requiring an elongate anode for current flow wherein the anode is lowered into the process and is consumed thereby;

FIG. 2 is a lengthwise sectional view through one anode portion;

FIG. 3 is a plan view of the anode of FIG. 2;

FIG. 4 shows coacting collar and pin structures;

FIG. 5 is a side view of several anode sections joined together to form an assembled anode;

FIG. 6 is a sectional view along the line 6—6 of FIG. 5 showing the manner in which the lower portion of the anode is consumed by the process; and FIG. 7 is an isometric view of the capture collar in the inverted position in comparison with FIG. 4.

DETAILED DESCRIPTION OF THE PREFERRED EMBODIMENT

Attention is first directed to FIG. 1 of the drawings. There, the numeral 10 identifies a process container. As an example but not a limitation, the process carried out is that of chemical conversion utilizing electric current flow to obtain magnesium or other suitable products. The structure utilizes a container 10 which is closed over by a ceramic cover 14. The cover is perforated at suitable locations to receive several anodes 16. The anodes extend through the cover 14 and are positioned adjacent to tapered cathodes 18. The several cathodes are supported by a suitable framework (omitted for sake of clarity) and are emersed in a liquid bath in the container 10. In the near vicinity of the cathodes, an electrochemical interchange occurs, liberating magnesium which rises in a collection sump 20. The collection sump 20 enables the liquid metal to be removed periodically. Ideally, a continuous process is carried on whereby the several anodes 16 are lowered to be consumed during operation. So that the electric circuit involved is understood, it is represented by a suitable source of direct current exemplified by the battery 22 which is connected to provide current flow to the anode 16. The current flows through the gap between anode and cathode in the liquid bath in the container 10, thereby forming magnesium and consuming the anode 16 in the process. The temperature of the bath is maintained within a temperature range in the order of 20° C.

such as through selective energization of the electrical circuit across the resistance of the anode/cathode gap. If additional heat is required to maintain the appropriate temperature range, such heat is supplied by means of a suitable heater below the container. As an example for manufacture of magnesium, a fused salt mixture is about 20% magnesium chloride ($MgCl_2$), about 60% common salt (NaCl), about 20% calcium chloride ($CaCl_2$), and is typically operated at a temperature range of about 700°–720° C. with gas heating utilized, if necessary, to maintain the appropriate temperature range.

Attention is next directed to FIG. 2 of the drawings. There, the numeral 24 identifies the lower matching face of a rectangular block formed of graphite. The upper face is identified by the numeral 26. The rectangular block is identified by the numeral 28. The anode block 28 is regular in shape and has a nominal height from about 20 inches to about 60 inches. A typical width is about 20–30 inches, and a thickness is typically in the range of about 5 inches. It is drilled with a pair of lengthwise holes or passages between specially shaped end socket openings. The lower opening or socket is identified by the numeral 30 and is a tapped and counterbored opening forming a cylindrical unthreaded surface portion 31. The counterbore extends to a specified depth, and the threads have a depth in the counterbored hole 30 to accommodate a particular structure as will be described. This arrangement is found at both of the drilled holes through the body 28. The lengthwise holes are identified by the numeral 32. The hole 32 is concentric with the counterbore at 30 and terminates at an upper end in a tapered countersunk opening 34. Again, the tapered countersunk area 34 is drilled to define a taper. The taper is shaped so that the threads in conjunction with the taper form a secure locking mechanism as will be described. The two holes are preferably symmetrical about a centerline through the body 28. Moreover, the end faces 24 and 26 are parallel to one other. This enables consecutive blocks to stack neatly with the faces in surface-to-surface contact.

For optimum transfer of electrical energy through the connected anode blocks, face-to-face abutment of the end face and accurate vertical alignment of the blocks is necessary. In FIGS. 4 and 7 of the drawings, a graphite collar 36 is included. The collar 36 is a hollow sleeve-like body having a set of threads 38 on the exterior. On the interior, it is axially hollow. One end of the collar is enlarged by means of a circumferential flange 40 which is notched across the upper face at 42 to receive a threading tool. When the collar 36 is threaded into the counterbored socket hole 30 as shown in FIG. 4, the flange of the collar is received in the undercut groove 44. The slots 42 are exposed to enable a suitable hand tool such as a spanner-like wrench to thread the collar fully into the bottom socket of the anode block. It should be noted in FIG. 4 that the pin is shown in elevation while the corresponding socket is shown in section. The thread of the pin and socket is of the opposite hand (right or left) as compared to the thread of the collar. The collar 36 is used to secure the pin 46 with its unthreaded external surfaces in full contact with opposed surfaces of the anode block and to orient the pins for accurate alignment with the tapered upper sockets of the next lower block. The pin has an enlarged head 48 at one end which has an undercut shoulder sized to fit over the collar 36 and to establish a close fitting relation with the unthreaded surface portion 31 of the socket 30. The collar thus captures the threaded pin so that the head of the pin is secured in the counterbored socket hole 30. The unthreaded portion of the pin is adjacent to the collar 38 while the tapered thread 50 thus protrudes below the anode block. When assembled, the tapered thread 50 extends downwardly from the body 28 and is rotatable to enable it to be threaded into the tapered counterbore 34. The threads 50 thus engage the mating threads 34 and join two adjacent anode blocks 28. The counter bore 30 is of sufficient depth so as to allow the pin to rise as the mating surfaces 22 and 26 of the blocks are brought into contact. The depth of the counter bore 30 also allows that the pins may be screwed in singularly and separately. The taper of the thread 50 on the pin 46 and in the socket 34 allow that the pin 46 and socket 34 need not be aligned at assembly with particular care and when tightened, the side faces 70 and 71 of the anode blocks move into alignment by virtue of the alignment activity of the tapered threads. The head of the pin includes a square or hex hole 52 which is centered and located so that a hand tool can be inserted through the passage 32 and drive the bolt head by engaging the hole 52. As an example, through the use of a hex head, an allen wrench can be inserted for purposes of threading up the pin. The wrench is extended through the passage 32 to bring two adjacent anode blocks 28 into a snug, tight and properly aligned relationship.

In summary, the collar 36 is threaded by rotation from the bottom, driving the collar in one hand (right or left) with a spanner-like tool which engages the slots 42 from the bottom. By contrast, the pin 46 is captured so that it can rotate when driven from above through the tool opening 32 with rotation on the opposite hand. The pin is driven by such a tool inserted through the drilled hole 32 and the downwardly protruding threads 50 are then threaded into the mating socket threads 34 at the top of the adjacent body. This can be repeated on both sides of the body; recall that there are two drilled holes and two sets of fittings involved. After both have been threaded snugly, the drilled holes 32 can be loosely filled with particulate material such as loose graphite. Alternatively, the drilled holes 32 can be filled with packing material such as salt compatible with the composition in the process vessel 10.

In the preferred embodiment, the collar and pin are both made of hardened graphite. The anode block 28 is also made of graphite. While there may be a difference in the hardness, this enables all of the components of the segmented anode to be consumed in the process. It is particularly important to assure that the adjacent portions of the completed anode are serially consumed, including the material forming fittings 36 and 46.

Attention is now directed to FIG. 5 of the drawings which shows the completed anode. Several units are joined, and they are assembled in the manner described above. More particularly, the first or bottom most is assembled to the next unit thereabove and this is repeated for several body portions 28 to form the assembled anode 16. A suitable hanger system is provided as shown generally at 60 and is incorporated for the purpose of supporting and controllably lowering the anode 16. Several dotted lines are included at 64 which depict lines along which the anode is steadily consumed by the electrothermical process occurring between anode and cathode. As shown in FIG. 1 of the drawings, the cathode is a V-shaped taper wherein the rectangular anode is removed during its use. It is consumed in the full sense of the word; the dotted lines represent the gradual consumption or sacrifice of the anode to the process. Moreover, FIG. 6 shows the anode in sectional view as it is partially reduced in cross section. Thus, it begins with full width as shown in FIG. 5 and it is reduced more or less to a tapered point. The spacing between the anode and cathode has significance in the rate at which the anode is consumed. The clearances between the connecting parts of the assembled joint are such that as even the pin 46 and collar 36 are partially to completely consumed, they will hold the two sections of anode together so long as they are not disturbed. Virtually all of each anode section is utilized; thus graphite waste and its consequent expense is effectively minimized.

While the foregoing is directed to the preferred embodiment of the present invention, other and further embodiments of the invention may be devised without departing from the basic invention thereof, and the scope thereof is determined by the claims which follow.

What is claimed is:

1. A sacrificial anode comprising an elongate graphite anode body having first and second end faces and first and second similar threaded graphite connector means connecting to said body to support a similar graphite anode body, said connector means having:

(a) collar means with an internal axially hollow passage;

(b) separate headed pin means received in said collar means for securing said pin means thereby at the head;

(c) said collar means having a thread of one hand for engagement with the thread of said body; and (d) said pin means having a threaded extending portion to join to a second and similar body wherein the threads are of the opposite hand.

2. The anode of claim 1 wherein said anode body has an internal socket therein, said internal socket conforming to one of said connector means to join thereto, and wherein said one connector means joins to a second and similar anode body.

3. The anode of claim 2 wherein:

(a) said body is of rectangular cross-sectional configuration;

(b) said body has a lengthwise passage connecting to said internal socket; and (c) said passage enabling a tool to be inserted therethrough to engage and actuate said connector means.

4. The anode of claim 3 wherein said connector means is formed of two parts, a first part being a threaded fitting extending from said body, and the second part being lock means securing said first part to said body.

5. The apparatus anode of claim 4 wherein said first and second parts established alignment of a similar anode body during connection of said anode body and said second and similar anode body.

6. The anode of claim 1 wherein said pin means includes a tool receiving receptacle in the head.

7. The anode of claim 1 wherein said collar means includes an end located collar having tool receiving slots in said end located collar.

8. The anode of claim 1 wherein said pin means has a head attached to a shaft with a nonthreaded portion for nesting in said collar means.

9. The anode of claim 1 wherein said pin means includes a tapered thread portion matching threads in said body.

10. The anode of claim 1 wherein said pin means includes shaft means equal in length to said collar means, and is rotatably received therein to be secured thereby.

11. The anode of claim 1 wherein said pin and collar means are made of hardened graphite.

12. The anode of claim 1 wherein said connector means maintain alignment of said anode portions.

13. the anode of claim 1 wherein said threaded extending portion of said pin means is of tapered form and is received within a similarly tapered internal socket of said second and similar anode body, said tapered threaded extending portion of said pin means and said tapered internal socket cooperate to establish alignment of said anode bodies during connection thereof.

14. The anode of claim 1 wherein said anode body defines a downwardly facing generally cylindrical socket having a lower threaded portion and an upper nonthreaded portion, said generally cylindrical socket is of sufficient length to permit vertical pin movement as the opposed end faces of said anode bodies are brought into abutment.

15. The anode of claim 14 wherein said threaded extending portion of said pin and mating threads of said anode body are tapered and established alignment of said anode bodies when threaded engagement is established therebetween.

16. A segment sacrificial anode for electrochemical process comprising:

(a) a plurality of substantially identical anode sections of generally rectangular cross-section composed of sacrificial material compatible with said process, each anode section forming:

(1) side surfaces of generally planar form;

(2) generally planar upper and lower end surfaces of substantially parallel relation;

(3) upper threaded socket means intersecting said upper end surface;

(4) lower threaded socket means intersecting said lower end surface;

(b) pin means of sacrificial material having a head portion receivable within said lower socket means and a threaded portion extending downwardly below said lower end surface means for threaded connection within said upper threaded socket means of a lower anode section; and (c) collar means of sacrificial material being threadedly received within said lower socket means and receiving said pin means therein, said collar means securing said pin means in rotatable assembly with said anode section.

17. The anode of claim 16 wherein said threaded portion of said pin and said upper threaded socket means are of tapered thread form and accomplish alignment of said anode sections during threading of said pin into said upper threaded socket means.

18. The anode of claim 17 wherein the dimensions of said lower threaded socket and said pin means permits relative vertical movement of said pin means and said anode section when end surfaces of adjacent anode bodies are brought into abutment.

19. The anode of claim 17 wherein:

(a) said anode sections each define tool passage means interconnecting said upper and lower threaded socket means; and (b) said pin means defines tool receptacle means enabling rotation of said pin means by tool means extending through said tool passage means for threading said pin means into said upper socket means.

* * * * *

UNITED STATES PATENT OFFICE

CERTIFICATE OF CORRECTION

PATENT NO. : 4,604,178

DATED : August 5, 1986

INVENTOR(S) : Dale R. Fiegener and Felix J. Broussard

It is certified that error appears in the above-identified patent and that said Letters Patent are hereby corrected as shown below:

Col. 1, line 20; "Mode" should be --more--.

Col. 5, line 52; "apparatus" should be deleted.

Col. 6, line 7; "the" should be --The--.

Signed and Sealed this

Seventh Day of April, 1987

*Attest:*

DONALD J. QUIGG

*Attesting Officer*

*Commissioner of Patents and Trademarks*